US011562698B2

(12) United States Patent
Wang et al.

(10) Patent No.: US 11,562,698 B2
(45) Date of Patent: Jan. 24, 2023

(54) DISPLAY PANEL, DRIVING METHOD THEREOF AND DISPLAY APPARATUS

(71) Applicants: Chengdu BOE Optoelectronics Technology Co., Ltd., Sichuan (CN); BOE Technology Group Co., Ltd., Beijing (CN)

(72) Inventors: Tsanghong Wang, Beijing (CN); Guixiang Zhu, Beijing (CN); Hsinwei Huang, Beijing (CN); Mancheng Zhou, Beijing (CN); Yao Liang, Beijing (CN)

(73) Assignees: Chengdu BOE Optoelectronics Technology Co., Ltd., Sichuan (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/276,489

(22) PCT Filed: Jun. 12, 2020

(86) PCT No.: PCT/CN2020/095915
§ 371 (c)(1),
(2) Date: Mar. 16, 2021

(87) PCT Pub. No.: WO2021/248481
PCT Pub. Date: Dec. 16, 2021

(65) Prior Publication Data

US 2022/0199036 A1 Jun. 23, 2022

(51) Int. Cl.
*G09G 3/3275* (2016.01)
*G09G 3/3266* (2016.01)

(52) U.S. Cl.
CPC ..... *G09G 3/3275* (2013.01); *G09G 3/3266* (2013.01); *G09G 2300/0426* (2013.01);
(Continued)

(58) Field of Classification Search
None
See application file for complete search history.

(56) References Cited

U.S. PATENT DOCUMENTS

2006/0114199 A1* 6/2006 Kim ..... G09G 3/3233 345/77
2006/0151745 A1* 7/2006 Kim ..... G09G 3/325 252/301.16
(Continued)

FOREIGN PATENT DOCUMENTS

CN 1924647 A 3/2007
CN 102054428 A 5/2011
(Continued)

OTHER PUBLICATIONS

European Search Report for 20940109.0 dated Oct. 25, 2022.

*Primary Examiner* — Afroza Chowdhury
*Assistant Examiner* — Amen W Bogale
(74) *Attorney, Agent, or Firm* — Ling Wu; Stephen Yang; Ling and Yang Intellectual Property

(57) ABSTRACT

A display panel includes multiple pixel units that are arranged regularly. A pixel circuit is connected with a scanning signal line and a data signal line. The pixel circuit receives a data voltage transmitted by the data signal line and outputs a corresponding current to a light emitting device under a control of the scanning signal line. When a first light emitting unit is in a black state, the data signal line provides a reference black state voltage to a pixel circuit of the first light emitting unit. The driving method of the display panel includes: providing, by the data signal line, a first black state voltage to a pixel circuit of a second light emitting unit when the first light emitting unit emits light and the second light emitting unit is in the black state. The first black state voltage is less than the reference black state voltage.

18 Claims, 4 Drawing Sheets

(52) U.S. Cl.
CPC ..... *G09G 2300/0452* (2013.01); *G09G 2300/0842* (2013.01); *G09G 2320/0238* (2013.01)

(56) References Cited

U.S. PATENT DOCUMENTS

| | | | | |
|---|---|---|---|---|
| 2012/0194569 | A1* | 8/2012 | Cheng | G09G 3/3614 345/89 |
| 2014/0071027 | A1 | 3/2014 | Jin et al. | |
| 2014/0118409 | A1 | 5/2014 | Jun et al. | |
| 2014/0168188 | A1* | 6/2014 | Jun | G09G 3/3233 345/212 |
| 2016/0035283 | A1 | 2/2016 | Park et al. | |
| 2016/0049117 | A1 | 2/2016 | Mitomi et al. | |
| 2017/0330518 | A1 | 11/2017 | Lee et al. | |
| 2019/0266941 | A1* | 8/2019 | Pyo | G09G 3/3233 |
| 2019/0304372 | A1 | 10/2019 | Pyo et al. | |
| 2019/0333439 | A1 | 10/2019 | Giannikouris et al. | |
| 2020/0143733 | A1 | 5/2020 | Kim et al. | |
| 2020/0175924 | A1* | 6/2020 | Bang | G09G 3/3233 |
| 2020/0274025 | A1 | 8/2020 | Wang et al. | |
| 2020/0380920 | A1* | 12/2020 | Lee | G09G 3/20 |

FOREIGN PATENT DOCUMENTS

| | | | |
|---|---|---|---|
| CN | 105981094 | A | 9/2016 |
| CN | 107393464 | A | 11/2017 |
| CN | 110930938 | A | 3/2020 |
| JP | 2008-309910 | A | 12/2008 |
| KR | 10-2019-0038141 | A | 4/2019 |
| WO | 2018188360 | A1 | 10/2018 |

* cited by examiner

DISPLAY PANEL, DRIVING METHOD THEREOF AND DISPLAY APPARATUS

CROSS-REFERENCE TO RELATED APPLICATION

The present application is a U.S. National Phase Entry of International Application No. PCT/CN2020/095915 having an international filing date of Jun. 12, 2020, which is incorporated herein by reference in its entirety.

TECHNICAL FIELD

The present disclosure relates to the technical field of display technology, in particular to a display panel, a driving method thereof and a display apparatus.

BACKGROUND

An Organic Light Emitting Diode (OLED) is an active light emitting display device, which has advantages including self-emission, a wide viewing angle, high contrast, low power consumption and a high response speed, etc. It has been widely applied in display products such as mobile phones, tablet computers and digital cameras, etc. Display of the OLED is driven by a current, and needs a pixel circuit to output a current to the OLED in order to drive the OLED to emit light.

SUMMARY

The following is a summary of the subject matter described in detail in the present disclosure. This summary is not intended to limit the protection scope of the claims.

A driving method of a display panel is provided. The display panel includes a plurality of pixel units that are arranged regularly; at least one of the plurality of pixel units includes a first light emitting unit which emits light of a first color, a second light emitting unit which emits light of a second color and a third light emitting unit which emits light of a third color; each light emitting unit includes a pixel circuit and a light emitting device electrically connected with the pixel circuit, the pixel circuit is connected with a scanning signal line and a data signal line, and the pixel circuit receives a data voltage transmitted by the data signal line and outputs a corresponding current to the light emitting device under a control of the scanning signal line; and when the first light emitting unit is in a black state, the data signal line provides a reference black state voltage to a pixel circuit of the first light emitting unit. The driving method includes: providing, by the data signal line, a first black state voltage to a pixel circuit of the second light emitting unit when the first light emitting unit emits light and the second light emitting unit is in the black state, where the first black state voltage is less than the reference black state voltage.

In some possible implementations, the driving method further includes: providing, by the data signal line, a second black state voltage to a pixel circuit of the third light emitting unit when the first light emitting unit emits light and the third light emitting unit is in the black state, where the second black state voltage is less than the reference black state voltage.

In some possible implementations, the first black state voltage is greater than or equal to the second black state voltage.

In some possible implementations, a turn-on voltage of a light emitting device of the first light emitting unit is less than or equal to a turn-on voltage of a light emitting device of the second light emitting unit, and the turn-on voltage of the light emitting device of the second light emitting unit is less than or equal to a turn-on voltage of a light emitting device of the third light emitting unit.

In some possible implementations, the turn-on voltage of the light emitting device of the first light emitting unit is 2.0V to 2.05V, the turn-on voltage of the light emitting device of the second light emitting unit is 2.05V to 2.10V, the turn-on voltage of the light emitting device of the third light emitting unit is 2.65V to 2.75V, and the reference black state voltage is 5.0V to 7.0V.

In some possible implementations, the first black state voltage is 0.85*the reference black state voltage to 0.95*the reference black state voltage.

In some possible implementations, the second black state voltage is 0.85*the reference black state voltage to 0.95*the reference black state voltage.

In some possible implementations, the pixel circuit is further connected with an initial signal line, the initial signal line provides a reference initial voltage to the pixel circuit of the first light emitting unit, and the driving method further includes: providing, by the initial signal line, a first initial voltage to the pixel circuit of the second light emitting unit when the first light emitting unit emits light and the second light emitting unit is in the black state, where the first initial voltage is greater than the reference initial voltage.

In some possible implementations, the driving method further includes: providing, by the initial signal line, a second initial voltage to a pixel circuit of the third light emitting unit when the first light emitting unit emits light and the third light emitting unit is in the black state, where the second initial voltage is greater than the reference initial voltage.

In some possible implementations, the first initial voltage is less than or equal to the second initial voltage.

In some possible implementations, the reference initial voltage is −2.2V to −2.0V.

In some possible implementations, the first initial voltage is 0.9*the reference initial voltage to 0.7*the reference initial voltage.

In some possible implementations, the second initial voltage is 0.9*the reference initial voltage to 0.7*the reference initial voltage.

In some possible implementations, the pixel circuit includes: a first transistor with a control electrode connected with a second scanning signal line, a first electrode connected with a first initial signal line and a second electrode connected with a second node; a second transistor with a control electrode connected with a first scanning signal line, a first electrode connected with the second node and a second electrode connected with a third node; a third transistor with a control electrode connected with the second node, a first electrode connected with a first node and a second electrode connected with the third node; a fourth transistor with a control electrode connected with the first scanning signal line, a first electrode connected with the data signal line and a second electrode connected with the first node; a fifth transistor with a control electrode connected with a light emitting signal line, a first electrode connected with a second power supply line and a second electrode connected with the first node; a sixth transistor with a control electrode connected with the light emitting signal line, a first electrode connected with the third node and a second electrode connected with a first electrode of the light emitting device; a seventh transistor with a control electrode connected with the first scanning signal line, a first electrode connected with the second initial signal line and a second electrode connected with the first electrode of the light emitting device, where a second electrode of the light emitting device is connected with a first power supply line; and a storage capacitor with a first end connected with the second power supply line and a second end connected with the second node.

In some possible implementations, the initial signal line is the second initial signal line. A display panel is provided. The display panel is driven by the driving method of the display panel described above.

A display apparatus is provided, which includes the display panel described above.

Other aspects will become apparent upon reading and understanding the accompanying drawings and the detailed description.

BRIEF DESCRIPTION OF DRAWINGS

Accompanying drawings are used to provide a further understanding of technical solutions of the present disclosure. The drawings form a part of the specification, and illustrate the technical solutions together with embodiments of the present disclosure. The drawings do not constitute a limitation on the technical solutions of the present disclosure. Shapes and sizes of the components in the drawings do not reflect true proportions, and the purpose is only for schematically describing contents of the present disclosure.

DETAILED DESCRIPTION

Figure 1:
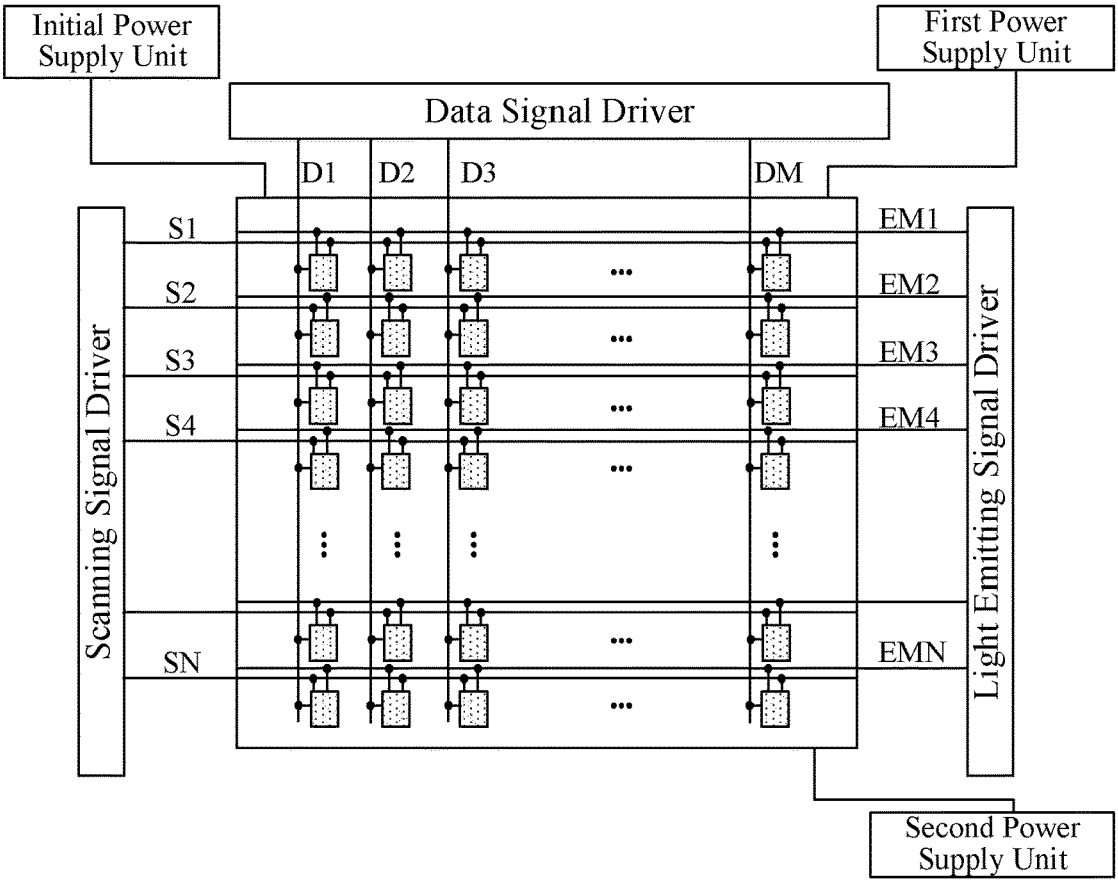
FIG. 1 is a schematic diagram of a structure of a display apparatus according to an exemplary embodiment of the present disclosure.

The embodiments herein may be implemented in a number of different ways. A person of ordinary skills in the art will readily understand the fact that implementations and contents may be transformed into a variety of forms without departing from the spirit and scope of the present disclosure. Therefore, the present disclosure should not be construed as being limited only to what is described in the following embodiments. Without conflict, embodiments in the present disclosure and features in the embodiments may be combined with each other arbitrarily.

In the drawings, a size of a constituent element, a thickness of a layer or an area of the layer may be sometimes exaggerated for clarity. Therefore, any implementation mode of the present disclosure is not necessarily limited to a size shown in the drawings, and the shapes and sizes of the components in the drawings do not reflect true proportions. In addition, the drawings schematically show ideal examples, and any implementation mode of the present disclosure is not limited to the shapes or values shown in the drawings.

In this disclosure, the "first", "second", "third" and other ordinal numbers are used to avoid confusion of constituent elements, but not to limit in quantity.

In this disclosure, for sake of convenience, wordings such as "central", "upper", "lower", "front", "rear", "vertical", "horizontal", "top", "bottom", "inner", "outer" and the like describe the orientations or positional relations of constituent elements with reference to the drawings, which are only for ease of description of this specification and for simplification of the description, rather than indicating or implying that the apparatus or element referred to must have a specific orientation, or must be constructed and operated in a particular orientation, and therefore cannot be construed as limitations on the present disclosure. The positional relations of the constituent elements may be appropriately changed according to the direction in which each constituent element is described. Therefore, they are not limited to the wordings in this disclosure, and may be replaced appropriately according to the situations.

In this disclosure, the terms "installed", "connected" and "coupled" shall be broadly understood unless otherwise explicitly specified and defined. For example, a connection may be a fixed connection, or may be a detachable connection, or an integrated connection; it may be a mechanical connection, or may be an electrical connection; it may be a direct connection, or may be an indirect connection through middleware, or may be an internal connection between two elements. Those of ordinary skill in the art can understand the specific meanings of the above mentioned terms in the present disclosure according to specific situations. In this disclosure, a transistor refers to an element with at least three terminals including a gate electrode, a drain electrode and a source electrode. The transistor may be a thin film transistor, a field effect transistor or another device with similar characteristics. The transistor has a channel region between the drain electrode (or referred to as a drain electrode terminal or a drain region) and the source electrode (or referred to as a source electrode terminal or a source region), and a current can flow through the drain electrode, the channel region and the source electrode. In this disclosure, the channel region refers to a region through which a current mainly flows.

In this disclosure, a gate electrode of a transistor is referred to as a control electrode. A first electrode may be a drain electrode, and a second electrode may be a source electrode. Alternatively, the first electrode may be a source electrode and the second electrode may be a drain electrode. In a situation where transistors with opposite polarities are used or a current direction is changed in an operation of a circuit, a function of the "source electrode" and a function of the "drain electrode" can sometimes be interchangeable. Therefore, the "source electrode" and the "drain electrode" can be interchangeable in this disclosure.

In this disclosure, an "electrical connection" includes a case where constituent elements are connected via an element having a certain electrical action. The "element having a certain electrical action" is not particularly limited as long as it can transmit and receive electrical signals between connected constituent elements. An "element with a certain electrical action" may be, for example, an electrode or wiring, a switching element such as a transistor, or other functional elements such as a resistor, an inductor or a capacitor, etc.

In this disclosure, "parallel" refers to a state in which two straight lines form an angle above −10 degrees and below 10 degrees, and thus also includes a state in which the angle is above −5 degrees and below 5 degrees. In addition, "perpendicular" refers to a state in which an angle above 80 degrees and below 100 degrees is formed, and thus also includes a state in which the angle is above 85 degrees and below 95 degrees.

In this disclosure, a "film" and a "layer" are interchangeable. For example, sometimes a "conductive layer" may be replaced with a "conductive film". Similarly, an "insulating film" may sometimes be replaced with an "insulating layer".

The term "about" in this disclosure refers to a description of a value whose boundaries are not strictly set so that an error range of process and measurement is allowed.

FIG. 1 is a schematic diagram of a structure of a display apparatus according to an exemplary embodiment of the present disclosure. As shown in FIG. 1, an OLED display apparatus may include a scanning signal driver, a data signal driver, a light emitting signal driver, an OLED display panel, a first power supply unit, a second power supply unit and an initial power supply unit. The display panel at least includes multiple scanning signal lines (S1 to SN), multiple data signal lines (D1 to DM) and multiple light emitting signal lines (EM1 to EMN). The scanning signal driver is configured to sequentially supply scanning signals to the display panel through the multiple scanning signal lines (S1 to SN). The data signal driver is configured to supply data signals to the display panel through the multiple data signal lines (D1 to DN). The light emitting signal driver is configured to sequentially supply light emitting control signals to the display panel through the multiple light emitting signal lines (EM1 to EMN). In an exemplary embodiment, the multiple scanning signal lines and the multiple light emitting signal lines extend along a horizontal direction, and the multiple data signal lines extend along a vertical direction. The multiple scanning signal lines and the multiple light emitting signal lines intersect with the multiple data signal lines to define multiple light emitting units. The first power supply unit, the second power supply unit and the initial power supply unit are configured to supply a first power supply voltage, a second power supply voltage and an initial power supply voltage to a pixel circuit through a first power supply line, a second power supply line and an initial signal line, respectively.

Figure 2:
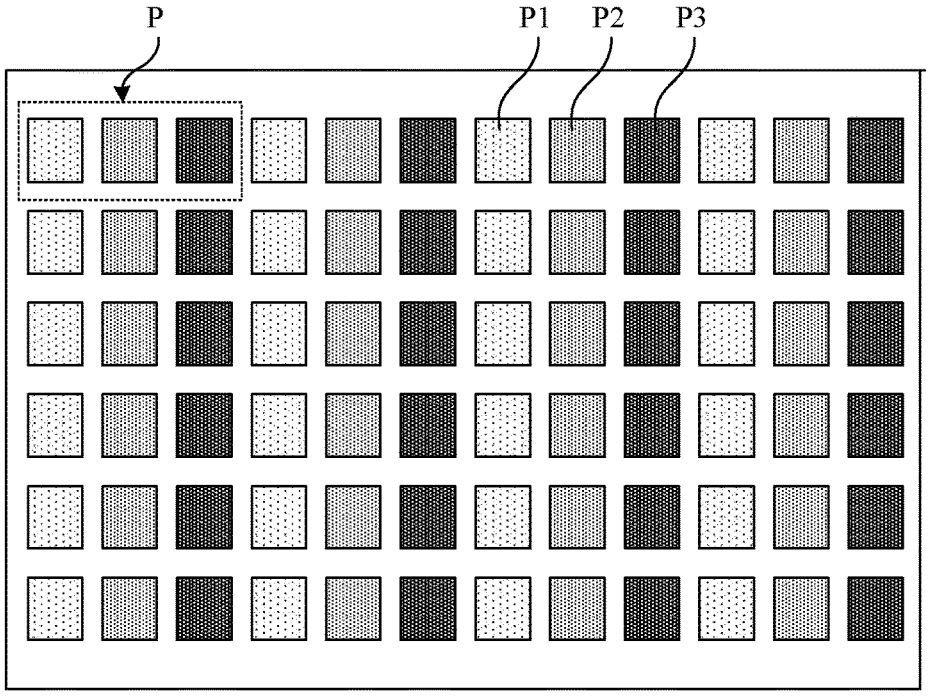
FIG. 2 is a schematic plane view of a structure of a display panel according to an exemplary embodiment of the present disclosure.

FIG. 2 is a schematic plane view of a structure of a display panel according to an exemplary embodiment of the present disclosure. As shown in FIG. 2, the display panel includes multiple pixel units P arranged in a matrix manner. At least one of the multiple pixel units P includes a first light emitting unit P1 that emits light of a first color, a second light emitting unit P2 that emits light of a second color and a third light emitting unit P3 that emits light of a third color. The first light emitting unit P1, the second light emitting unit P2 and the third light emitting unit P3 each include a pixel circuit and a light emitting device. Pixel circuits in the first light emitting unit P1, the second light emitting unit P2 and the third light emitting unit P3 are respectively connected with the scanning signal lines and the data signal lines. A pixel circuit is configured to receive a data voltage transmitted by a data signal line and output a corresponding current to a light emitting device under a control of a scanning signal line. The light emitting devices in the first light emitting unit P1, the second light emitting unit P2 and the third light emitting unit P3 are electrically connected with the pixel circuits of the corresponding light emitting units, respectively. A light emitting device in a light emitting unit is configured to, in response to a current output by a pixel circuit of the corresponding light emitting unit, emit light with a corresponding brightness.

In an exemplary embodiment, a pixel unit P may include a red light emitting unit, a green light emitting unit and a blue light emitting unit; alternatively, the pixel unit may include a red light emitting unit, a green light emitting unit, a blue light emitting unit and a white light emitting unit, which is not limited in the present disclosure. In an exemplary embodiment, a shape of a light emitting unit in the pixel unit may be a rectangle, a diamond, a pentagon or a hexagon, etc. When the pixel unit includes three light emitting units, the three light emitting units may be arranged in a manner to stand side by side horizontally, in a manner to stand side by side vertically, or in a pyramid manner with two units sitting at the bottom and one unit placed on top. When the pixel unit includes four light emitting units, the four light emitting units may be arranged in a manner to stand side by side horizontally, in a manner to stand side by side vertically, or in a manner to form a square, which is not specifically limited in the present disclosure.

Figure 3:
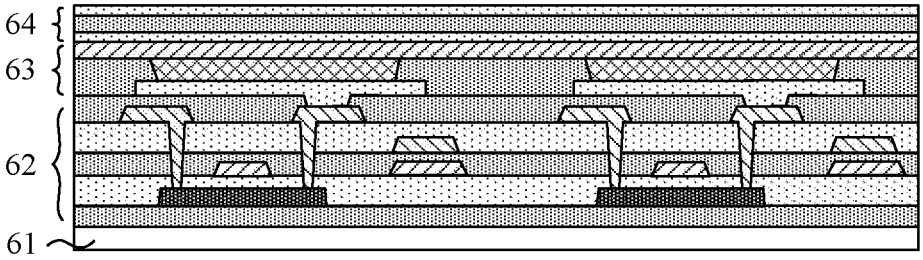
FIG. 3 is a schematic sectional view of a structure of a display panel according to an exemplary embodiment of the present disclosure.

FIG. 3 is a schematic sectional view of a structure of a display panel according to an exemplary embodiment of the present disclosure, and illustrates a structure of two light emitting units in an OLED display panel. As shown in FIG. 3, on a plane perpendicular to the display panel, the display panel includes a driving circuit layer 62 disposed on a substrate 61, a light emitting structure layer 63 disposed on the driving circuit layer 62 and an encapsulation layer 64 disposed on the light emitting structure layer 63. In some possible implementations, the display panel may include other film layers, which is not limited in the present disclosure.

In an exemplary implementation, the substrate 61 may be a flexible substrate or may be a rigid substrate. The flexible substrate may include a first flexible material layer, a first inorganic material layer, a semiconductor layer, a second flexible material layer and a second inorganic material layer that are stacked together. Material of the first flexible material layer and the second flexible material layer may be polyimide (PI), polyethylene terephthalate (PET) or polymer soft film after surface treatment, etc. Material of the first inorganic material layer and the second inorganic material layer may be silicon nitride (SiNx) or silicon oxide (SiOx), etc., to improve water and oxygen resistance capability of the substrate. Material of the semiconductor layer may be amorphous silicon (a-Si).

In an exemplary implementation, the driving circuit layer 62 may include a transistor and a storage capacitor that constitute a pixel circuit. FIG. 3 illustrates an example in which each light emitting unit includes a transistor and a storage capacitor. In some possible implementations, the driving circuit layer 62 of each light emitting unit may include: a first insulating layer disposed on the substrate; an active layer disposed on the first insulating layer; a second insulating layer that covers the active layer; a gate electrode and a first capacitor electrode disposed on the second insulating layer; a third insulating layer that covers the gate electrode and the first capacitor electrode; a second capacitor electrode disposed on the third insulating layer; a fourth insulating layer that covers the second capacitor electrode, where the fourth insulating layer is provided with via holes, and the via holes expose the active layer; a source electrode and a drain electrode disposed on the fourth insulating layer, where the source electrode and the drain electrode are connected with the active layer through the via holes, respectively; and a planarization layer that covers the aforementioned structure. The active layer, the gate electrode, the source electrode and the drain electrode constitute a transistor, and the first capacitor electrode and the second capacitor electrode constitute a storage capacitor. In some possible implementations, the first insulating layer, the second insulating layer, the third insulating layer and the fourth insulating layer may be made of any one or more of silicon oxide (SiOx), silicon nitride (SiNx) and silicon oxynitride (SiON), and may be a single layer, multiple layers or a composite layer. The first insulating layer may be referred to as a buffer layer, which is used to improve the water and oxygen resistance capability of the substrate. The second insulating layer and the third insulating layer may be referred to as gate insulating (GI) layers. The fourth insulating layer may be referred to as an interlayer insulating (ILD) layer. The first metal thin film, the second metal thin film and the third metal thin film may be made of metal materials, such as any one or more of silver (Ag), copper (Cu), aluminum (Al), titanium (Ti) and molybdenum (Mo), or alloy materials of the above metals, such as aluminum neodymium alloy (AlNd) or molybdenum niobium alloy (MONb), and may have a single-layer structure or a multi-layer composite structure, such as Ti/Al/Ti. The active layer thin film may be made of materials such as amorphous indium gallium zinc oxide (a-IGZO), zinc oxynitride (ZnON), indium zinc tin oxide (IZTO), amorphous silicon (a-Si), polysilicon (p-Si), hexathiophene, or polythiophene, etc. That is, the present disclosure is applicable to transistors that are manufactured based on oxide technology, silicon technology or organic technology. The active layer based on the oxide technology may be made of: an oxide that includes indium and tin; an oxide that includes tungsten and indium; an oxide that includes tungsten, indium and zinc; an oxide that includes titanium and indium; an oxide that includes titanium, indium and tin; an oxide that includes indium and zinc; an oxide that includes silicon, indium and tin; or an oxide that includes indium, gallium and zinc, etc.

In an exemplary implementation, the light emitting structure layer 63 may include an anode, a pixel defining layer, an organic light emitting layer and a cathode. The anode is disposed on the planarization layer, and is connected with the drain electrode through a via hole provided on the planarization layer. The pixel defining layer is disposed on the anode and the planarization layer, and is configured with a pixel opening to expose the anode. The organic light emitting layer is disposed in the pixel opening. The cathode is disposed on the organic light emitting layer. The organic light emitting layer emits light of a corresponding color under an action of a voltage applied by the anode and the cathode.

In an exemplary implementation, the encapsulation layer 64 may include a first encapsulation layer, a second encapsulation layer and a third encapsulation layer that are stacked together. The first encapsulation layer and the third encapsulation layer may be made of an inorganic material, and the second encapsulation layer may be made of an organic material. The second encapsulation layer is disposed between the first encapsulation layer and the third encapsulation layer to ensure that external moisture cannot enter into the light emitting structure layer 63.

In an exemplary implementation, the organic light emitting layer may at least include a hole injection layer (HIL), a hole transport layer (HTL), an emission layer (EML), an electron transport layer (ETL) and an electron injection layer (EIL) which are stacked together. The hole injection layer and the hole transport layer may be collectively referred to as a hole layer, and the electron transport layer and the electron injection layer may be collectively referred to as an electron layer. Because the hole layer and the electron layer are common layers that cover multiple light emitting units, a lateral leakage of a driving current may occur between adjacent light emitting units through the hole layer and the electron layer.

Due to difference in luminescent materials of different colors and deviation in preparation processes, light emitting units that emit light of different colors may have different turn-on voltages. A turn-on voltage of a light emitting device refers to a voltage needed by the device when the light emitting device emits light with a set brightness. For example, the set brightness is 1 cd/$m^2$. A low turn-on voltage indicates that an ohmic contact property between the two electrodes of the light emitting device and the organic light emitting layer is good and carriers can be injected with no need to overcome a large barrier; however, the turn-on voltage of the light emitting device is not less than an energy gap of the light emitting material, which is an intrinsic barrier needed to be overcome in a minimum. In an exemplary implementation, light of the first color may be red light, and the first light emitting unit P1 may be a red light emitting unit. Light of the second color may be green light, and the second light emitting unit P2 may be a green light emitting unit. Light of the third color may be blue light, and the third light emitting unit P3 may be a blue light emitting unit.

In an exemplary implementation, a light emitting device of the red light emitting unit has a first turn-on voltage $VK1_{ON}$, a light emitting device of the green light emitting unit has a second turn-on voltage $VK2_{ON}$, and a light emitting device of the blue light emitting unit has a third turn-on voltage $VK3_{ON}$. The first turn-on voltage $VK1_{ON}$ is less than or equal to the second turn-on voltage $VK2_{ON}$, and the second turn-on voltage $VK2_{ON}$ is less than or equal to the third turn-on voltage $VK3_{ON}$.

In an exemplary implementation, the first turn-on voltage $VK1_{ON}$ is 2.0V to 2.05V, the second turn-on voltage $VK2_{ON}$ is 2.05V to 2.10V, and the third turn-on voltage $VK3_{ON}$ is 2.65V to 2.75V. In some possible implementations, the first turn-on voltage $VK1_{ON}$ is 2.0V, the second turn-on voltage $VK2_{ON}$ is 2.05V, and the third turn-on voltage $VK3_{ON}$ is 2.7V.

In an exemplary implementation, the pixel circuit may have a structure of 5T1C, 5T2C, 6T1C or 7T1C. In some possible implementations, the pixel circuit may have a structure of 6T1C or 7T1C, and a theoretical charged voltage of a storage capacitor at the end of a charging stage is a difference value between a data voltage and a threshold voltage of a driving transistor.

Figure 4:
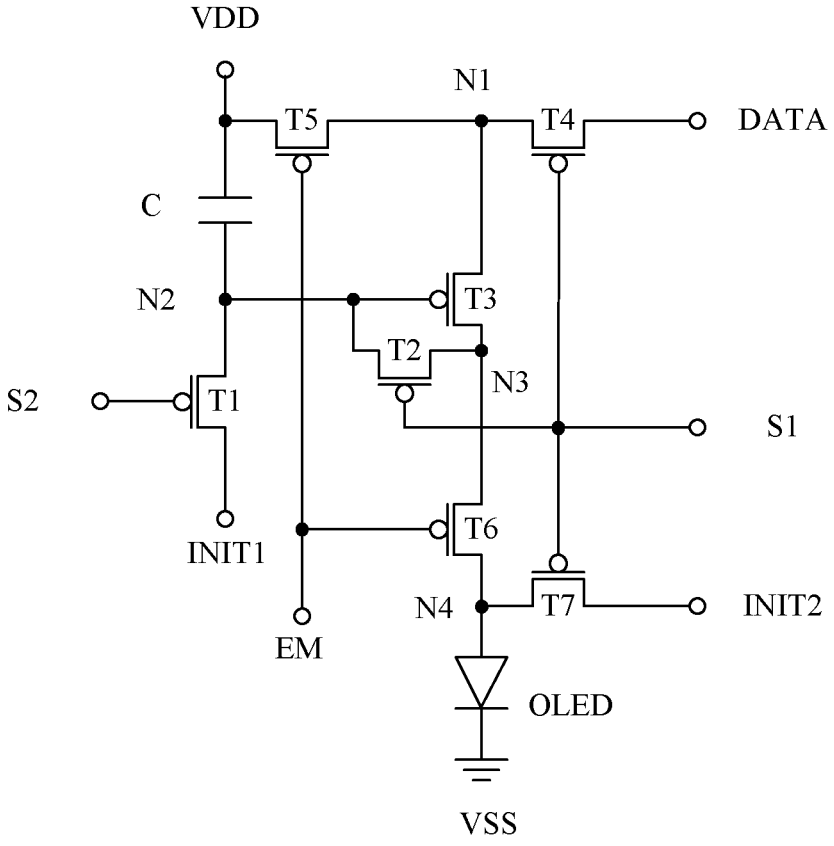
FIG. 4 is an equivalent circuit diagram of a pixel circuit according to an exemplary embodiment of the present disclosure.

FIG. 4 is an equivalent circuit diagram of a pixel circuit according to an exemplary embodiment of the present disclosure. As shown in FIG. 4, the pixel circuit may include seven switching transistors (a first transistor T1 to a seventh transistor T7), a storage capacitor C and eight signal lines (a data signal line DATA, a first scanning signal line S1, a second scanning signal line S2, a first initial signal line INIT1, a second initial signal line INIT2, a first power supply line VSS, a second power supply line VDD and a light emitting signal line EM).

In an exemplary implementation, a control electrode of the first transistor T1 is connected with the second scanning signal line S2, a first electrode of the first transistor T1 is connected with the first initial signal line INIT1, and a second electrode of the first transistor is connected with a second node N2.

In an exemplary implementation, a control electrode of the second transistor T2 is connected with the first scanning signal line S1, a first electrode of the second transistor T2 is connected with the second node N2, and a second electrode of the second transistor T2 is connected with a third node N3.

In an exemplary implementation, a control electrode of the third transistor T3 is connected with the second node N2, a first electrode of the third transistor T3 is connected with a first node N1, and a second electrode of the third transistor T3 is connected with the third node N3.

In an exemplary implementation, a control electrode of the fourth transistor T4 is connected with the first scanning signal line S1, a first electrode of the fourth transistor T4 is connected with the data signal line DATA, and a second electrode of the fourth transistor T4 is connected with the first node N1.

In an exemplary implementation, a control electrode of the fifth transistor T5 is connected with the light emitting signal line EM, a first electrode of the fifth transistor T5 is connected with the second power supply line VDD, and a second electrode of the fifth transistor T5 is connected with the first node N1.

In an exemplary implementation, a control electrode of the sixth transistor T6 is connected with the light emitting signal line EM, a first electrode of the sixth transistor T6 is connected with the third node N3, and a second electrode of the sixth transistor T6 is connected with a first electrode of the light emitting device.

In an exemplary implementation, a control electrode of the seventh transistor T7 is connected with the first scanning signal line S1, a first electrode of the seventh transistor T7 is connected with the second initial signal line INIT2, and a second electrode of the seventh transistor T7 is connected with the first electrode of the light emitting device.

In an exemplary implementation, a first end of the storage capacitor C is connected with the second power supply line VDD, and a second end of the storage capacitor C is connected with the second node N2.

In an exemplary implementation, the first transistor T1 to the seventh transistor T7 may be P-type transistors or may be N-type transistors. Adopting transistors of the same type in the pixel circuit can simplify a process flow, reduce difficulty in a preparation process of the display panel, and improve a product yield rate. In some possible implementations, the first transistor T1 to the seventh transistor T7 may include P-type transistors and N-type transistors.

In an exemplary implementation, a second electrode of the light emitting device is connected with the first power supply line VSS. A signal on the first power supply line VSS is a low level signal, and a signal on the second power supply line VDD is a high level signal that is continuously supplied.

In an exemplary implementation, the display panel may include a display region and a non-display region. The multiple light emitting units are located in the display region, and the first power supply line VSS is located in the non-display region. In some possible implementations, the non-display region may surround the display region.

In an exemplary implementation, the display panel may include a scanning signal driver, a timing controller and a clock signal line which are located in the non-display region. The scanning signal driver is connected with the first scanning signal line S1 and the second scanning signal line S2. The clock signal line is connected with the timing controller and the scanning signal driver, respectively. The clock signal line is configured to supply a clock signal to the scanning signal driver under a control of the timing controller. In some possible implementations, there are multiple clock signal lines to provide clock signals to multiple scanning signal drivers respectively. In an exemplary implementation, the display panel may include a data signal driver. The data signal driver is connected with the data signal line.

In an exemplary implementation, scanning signal lines and data signal lines intersect with each other perpendicularly to define multiple light emitting units that are arranged in a matrix manner. A first scanning signal line and a second scanning signal line define a display row, and adjacent data signal lines define a display column. The first light emitting unit P1, the second light emitting unit P2 and the third light emitting unit P3 may be periodically arranged along a direction of the display row. In some possible implementations, the first light emitting unit P1, the second light emitting unit P2 and the third light emitting unit P3 may be periodically arranged along a direction of the display column.

In an exemplary implementation, the first scanning signal line S1 is a scanning signal line for a pixel circuit of a current display row, and the second scanning signal line S2 is a scanning signal line for a pixel circuit of a previous display row. That is, for an $n^{th}$ display row, the first scanning signal line S1 is S(n), the second scanning signal line S2 is S(n−1), the second scanning signal line S2 of the current display row and the first scanning signal line S1 for the pixel circuit of the previous display row are the same signal line. Therefore, the signal lines of the display panel can be reduced, and a narrow frame of the display panel can be achieved.

In an exemplary implementation, the first scanning signal line S1, the second scanning signal line S2, the light emitting signal line EM, the first initial signal line INIT1 and the second initial signal line INIT2 extend in a horizontal direction. The first power supply line VSS, the second power supply line VDD and the data signal line DATA extend in a vertical direction.

In an exemplary implementation, the light emitting device may be an organic light emitting diode (OLED), which includes a first electrode (an anode), an organic light emitting layer and a second electrode (a cathode) that are stacked together.

Figure 5:
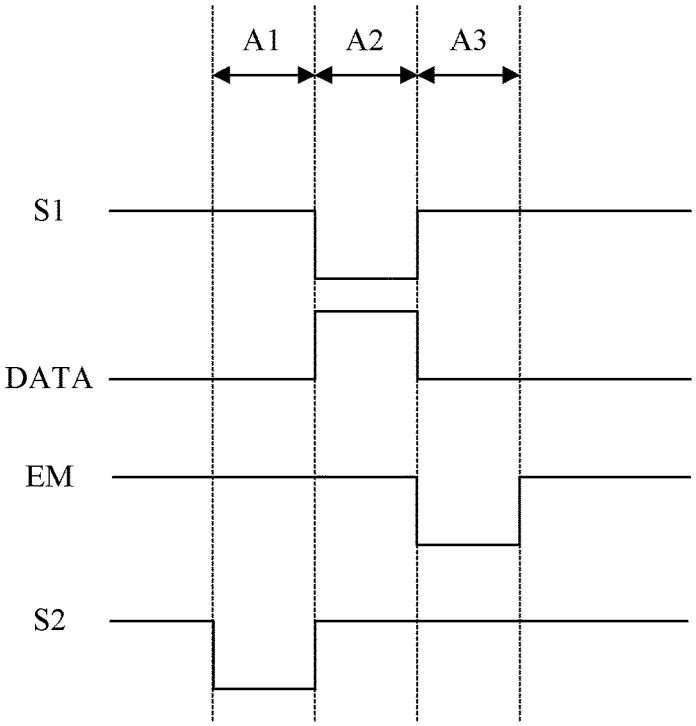
FIG. 5 is an operation timing diagram of a pixel circuit according to an exemplary embodiment of the present disclosure.

FIG. 5 is an operation timing diagram of a pixel circuit according to an exemplary embodiment of the present disclosure. In the following, a working process of the pixel circuit illustrated in FIG. 4 is used to illustrate an exemplary embodiment of this disclosure. The pixel circuit in FIG. 4 includes seven transistors (the first transistor T1 to the seventh transistor T7), a storage capacitor C and eight signal lines (the data signal line DATA, the first scanning signal line S1, the second scanning signal line S2, the first initial signal line INIT1, the second initial signal line INIT2, the first power supply line VSS, the second power supply line VDD and the light emitting signal line EM). The seven transistors are all P-type transistors.

In an exemplary implementation, the working process of the pixel circuit may include:

In a first stage A1, referred to as a reset stage, a signal of the second scanning signal line S2 is a low level signal, and signals of the first scanning signal line S1 and the light emitting signal line EM are high level signals. The signal of the second scanning signal line S2 is a low level signal, which causes the first transistor T1 to be turned on. A signal of the first initial signal line INIT1 is provided to the second node N2 to initialize the storage capacitor C, so that an existing data voltage in the storage capacitor is cleared up. The signals of the first scanning signal line S1 and the light emitting signal line EM are high level signals, which causes the second transistor T2, the fourth transistor T4, the fifth transistor T5, the sixth transistor T6 and the seventh transistor T7 to be turned off. The OLED does not emit light during this stage.

In a second stage A2, referred to as a data writing stage or a threshold compensation stage, the signal of the first scanning signal line S1 is a low level signal, the signals of the second scanning signal line S2 and the light emitting signal line EM are high level signals, and the data signal line DATA outputs a data voltage. During this stage, because the second end of the storage capacitor C is at a low level, the third transistor T3 is turned on. The signal of the first scanning signal line S1 is a low level signal, which causes the second transistor T2, the fourth transistor T4 and the seventh transistor T7 to be turned on. The second transistor T2 and the fourth transistor T4 are turned on, so that the data voltage output by the data signal line DATA is provided to the second node N2 through the first node N1, the turned-on third transistor T3, the third node N3 and the turned-on second transistor T2. Then, a difference value between the data voltage output by the data signal line DATA and the threshold voltage of the third transistor T3 is charged into the storage capacitor C. The voltage at the second end (the second node N2) of the storage capacitor C is Vdata−|Vth|. Vdata is the data voltage output by the data signal line DATA, and Vth is the threshold voltage of the third transistor T3. The seventh transistor T7 is turned on, so that the initial voltage of the second initial signal line INIT2 is provided to the first electrode of the OLED to initialize (reset) the first electrode of the OLED. A pre-stored internal voltage of the first electrode of the OLED is cleared up, and the initialization is completed to ensure that the OLED does not emit light. The signal of the second scanning signal line S2 is a high level signal, which causes the first transistor T1 to be turned off. The signal of the light emitting signal line EM is a high level signal, which causes the fifth transistor T5 and the sixth transistor T6 to be turned off.

In a third stage A3, referred to as a light emitting stage, the signal of the light emitting signal line EM is a low level signal, and the signals of the first scanning signal line S1 and the second scanning signal line S2 are high level signals. The signal of the light emitting signal line EM is a low level signal, which causes the fifth transistor T5 and the sixth transistor T6 to be turned on. Through the turned-on fifth transistor T5, the turned-on third transistor T3 and the turned-on sixth transistor T6, a power supply voltage output by the second power supply line VDD provides a driving voltage to the first electrode of the OLED so as to drive the OLED to emit light.

In an exemplary implementation, the data signal driver is provided with a voltage curve, with a "0" gray scale of a black image as the lowest gray scale and a "255" gray scale of a white image as the highest gray scale, or with a "0" gray scale of a white image as the lowest gray scale and a "255" gray scale of a black image as the highest gray scale. Based on the voltage curve, the data signal driver provides data voltages (Gamma) to the light emitting unit for displaying gray scales from the "0" gray scale to the "255" gray scale. In a driving process of the pixel circuit, a driving current flowing through the third transistor T3 (a driving transistor) is determined based on a voltage difference between the control electrode and the first electrode of the third transistor T3. Since a voltage of the second node N2 is Vdata−|Vth|, the driving current of the third transistor T3 is:

$$I=K^*(Vgs-Vth)^2=K^*[(Vdd-V\text{data}+|Vth|)-Vth]^2=K^*(Vdd-V\text{data})^2.$$

Here, I is the driving current flowing through the third transistor T3, that is, the driving current that drives the OLED to emit light; K is a constant; Vgs is a voltage difference between the control electrode and the first electrode of the third transistor T3; Vth is a threshold voltage of the third transistor T3; Vdata is a data voltage output by the data signal line DATA; and Vdd is a power supply voltage output by the second power supply line VDD.

In an exemplary implementation, for the first light emitting unit that emits red light: when the first light emitting unit emits red light, a data voltage output by the data signal line DATA is VR0; when the first light emitting unit is in a black state (not emitting light), a data voltage output by the data signal line DATA is VRb; and a potential of a fourth node N4 in a pixel circuit of the first light emitting unit is VRN. For the second light emitting unit that emits green light: when the second light emitting unit emits green light, a data voltage output by the data signal line DATA is VG0; when the second light emitting unit is in a black state (not emitting light), a data voltage output by the data signal line DATA is VGb; and a potential of a fourth node N4 in a pixel circuit of the second light emitting unit is VGN. For the third light emitting unit that emits blue light: when the third light emitting unit emits blue light, a data voltage output by the data signal line DATA is VB0; when the third light emitting unit is in a black state (not emitting light), a data voltage output by the data signal line DATA is VBb; and a potential of a fourth node N4 in a pixel circuit of the third light emitting unit is VBN.

In an exemplary implementation, when the first light emitting unit is in the black state, the data voltage VRb provided by the data signal line DATA to the pixel circuit of the first light emitting unit is referred to as a reference black state voltage VB.

In an exemplary implementation, when the first light emitting unit emits light and the second light emitting unit is in the black state, the data voltage VGb provided by the data signal line DATA to the pixel circuit of the second light emitting unit is referred to as a first black state voltage VB1. The first black state voltage VB1 is smaller than the reference black state voltage VB.

In an exemplary implementation, when the first light emitting unit emits light and the third light emitting unit is in the black state, the data voltage VBb provided by the data signal line DATA to the pixel circuit of the third light emitting unit is referred to as a second black state voltage VB2. The second black state voltage VB2 is smaller than the reference black state voltage VB.

In an exemplary implementation, when the second light emitting unit emits light and the third light emitting unit is in the black state, the data voltage VBb provided by the data signal line DATA to the pixel circuit of the third light emitting unit is referred to as a third black state voltage VB3. The third black state voltage VB3 is smaller than the reference black state voltage VB.

In an exemplary implementation, when the first light emitting unit emits light and the second light emitting unit and the third light emitting unit are both in the black state: the first black state voltage VB1 provided by the data signal line DATA to the pixel circuit of the second light emitting unit is smaller than the reference black state voltage VB; the second black state voltage VB2 provided by the data signal line DATA to the pixel circuit of the third light emitting unit is smaller than the reference black state voltage VB; and the first black state voltage VB1≥the second black state voltage VB2.

In an exemplary implementation, the second black state voltage VB2 is equal to the third black state voltage VB3.

In the following, illustrative description is provided by taking the power supply voltage Vss output by the first power supply line VSS being −4V and the data voltage output by the data signal line DATA being 2.0V to 6.1V as an example.

When the first light emitting unit is in the black state, the reference black state voltage VB provided by the data signal line DATA to the pixel circuit of the first light emitting unit is 6.1V, which causes the potential of the fourth node N4 in the pixel circuit of the first light emitting unit to be −4.0V.

In a method for driving pixel circuits, in a case where the first light emitting unit emits light and the second light emitting unit is in the black state, the data voltage VR0 provided by the data signal line DATA to the pixel circuit of the first light emitting unit is 2.0V, and the data voltage provided by the data signal line DATA to the pixel circuit of the second light emitting unit is the reference black state voltage VB. The data voltage VR0 provided by the data signal line DATA to the pixel circuit of the first light emitting unit is 2.0V, which causes the OLED of the first light emitting unit to emit light and the potential VRN of a fourth node N4 in the pixel circuit of the first light emitting unit to be −1.8V. The data voltage provided by the data signal line DATA to the pixel circuit of the second light emitting unit is 6.1V, which causes the OLED of the second light emitting unit not to emit light and causes the potential VGN of the fourth node N4 in the pixel circuit of the second light emitting unit to be −4.0V. Because a difference value between the potential VRN of the fourth node N4 in the pixel circuit of the first light emitting unit and the potential VGN of the fourth node N4 in the pixel circuit of the second light emitting unit is relatively large (about 2.2V), a driving current of the pixel circuit of the first light emitting unit may flow to the pixel circuit of the second light emitting unit, resulting in a lateral leakage. Because the lateral leakage reduces the driving current that flows through the OLED of the first light emitting unit, a brightness of the OLED of the first light emitting unit is reduced, resulting in a grey crush.

Figure 6:
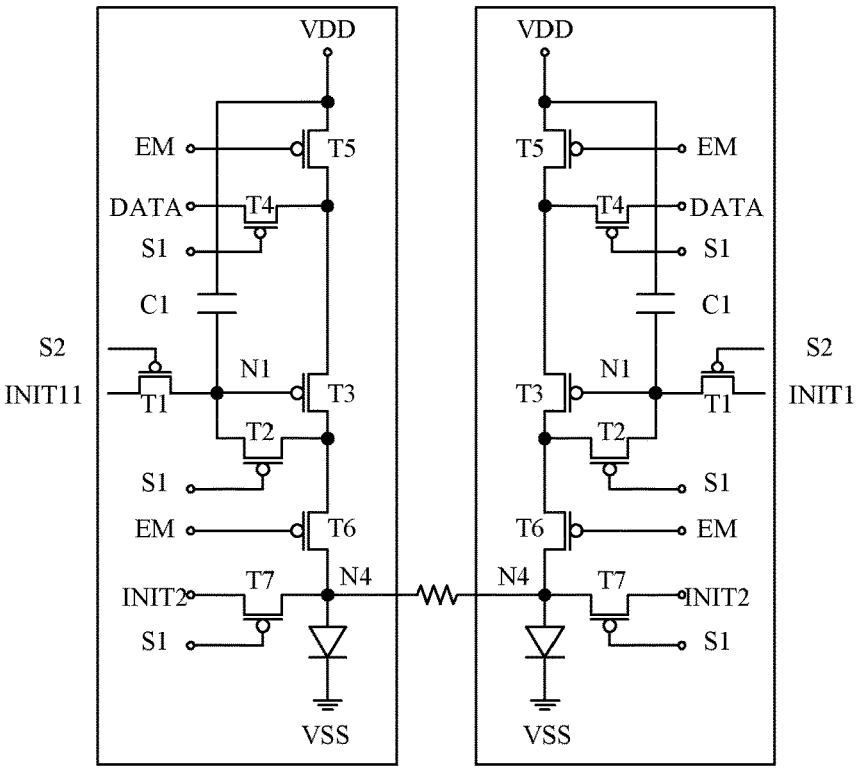
FIG. 6 is a schematic diagram illustrating a lateral leakage.

FIG. 6 is a schematic diagram illustrating a lateral leakage. In an exemplary implementation, a pixel circuit of a red light emitting unit may be on the left side, and a pixel circuit of a green light emitting unit may be on the right side. As shown in FIG. 6, when a difference value between a potential of a fourth node N4 in the pixel circuit on the left side and a potential of a fourth node N4 in the pixel circuit on the right side is relatively large, a lateral leakage occurs between the fourth node N4 of the pixel circuit on the left side and the fourth node N4 of the pixel circuit on the right side.

Figure 7:
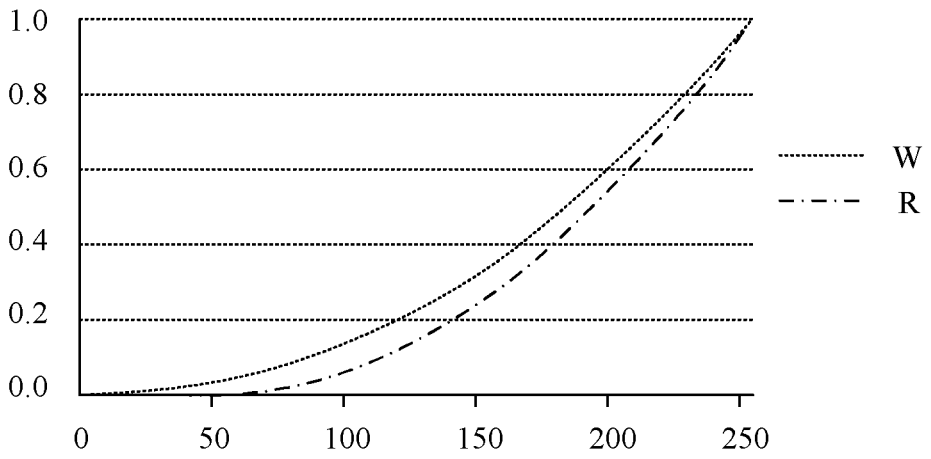
FIG. 7 is a schematic diagram illustrating a grey crush.

FIG. 7 is a schematic diagram illustrating a grey crush. An abscissa axis denotes a gray scale, an ordinate axis denotes brightness, a dotted line denotes a curve of white (W) brightness, and a dotted-dashed line denotes a curve of red (R) brightness. As shown in FIG. 7, the white brightness increases as the gray scale increases, and a change on the white brightness is gradual. However, a change on the red brightness is not gradual. In a range from a "0" gray scale to a "75" gray scale, the red brightness is basically 0. That is, the red light emitting unit does not emit light in this range basically. A situation where the red light emitting unit has no gradual change on its brightness when the brightness is relatively low is referred to as a grey crush. It is found by research that a grey crush phenomenon is caused by a lateral leakage to some extent. The lateral leakage reduces a driving current that flows through an OLED of the red light emitting unit. When the driving current is relatively small, it may cause a failure on the OLED of the red light emitting unit to emit light. Only when the driving current is relatively large, the OLED of the red light emitting unit begins to emit light.

In a method for driving pixel circuits according to an exemplary embodiment of the present disclosure, in a case where the first light emitting unit emits light and the second light emitting unit is in the black state, the data voltage VR0 provided by the data signal line DATA to the pixel circuit of the first light emitting unit is 2.0V. The data signal line DATA provides the first black state voltage VB1 to the pixel circuit of the second light emitting unit. The first black state voltage VB1 is 5.8V, and is smaller than the reference black state voltage VB. The data voltage VR0 provided by the data signal line DATA to the pixel circuit of the first light emitting unit is 2.0V, which causes the OLED of the first light emitting unit to emit light and the potential VRN of the fourth node N4 in the pixel circuit of the first light emitting unit to be −1.8V. The first black state voltage VB1 provided by the data signal line DATA to the pixel circuit of the second light emitting unit is 5.8V, which causes the potential VGN of the fourth node N4 in the pixel circuit of the second light emitting unit to be −2.2V. Although the potential VGN of the fourth node N4 in the pixel circuit of the second light emitting unit increases and a voltage difference between an anode and a cathode of the OLED of the second light emitting unit is 1.8V, it can still be ensured that the OLED of the second light emitting unit does not emit light. This is because a turn-on voltage of the OLED of the second light emitting unit is 2.05V to 2.10V and the voltage difference between the anode and the cathode of the OLED is smaller than the turn-on voltage of the OLED. Because a difference value between the potential VRN of the fourth node N4 in the pixel circuit of the first light emitting unit and the potential VGN of the fourth node N4 in the pixel circuit of the second light emitting unit is relatively small (0.4V), the lateral leakage between the pixel circuit of the first light emitting unit and the pixel circuit of the second light emitting unit is reduced. A loss of the driving current in the OLED of the first light emitting unit is reduced, and the brightness of the OLED of the first light emitting unit is ensured. As a result, the grey crush phenomenon is avoided.

In a method for driving pixel circuits according to an exemplary embodiment of the present disclosure, in a case where the first light emitting unit emits light and the third light emitting unit is in the black state, the data voltage VR0 provided by the data signal line DATA to the pixel circuit of the first light emitting unit is 2.0V. The data signal line DATA provides the second black state voltage VB2 to the pixel circuit of the third light emitting unit. The second black state voltage VB2 is 5.7V, and is smaller than the reference black state voltage VB. The data voltage VR0 provided by the data signal line DATA to the pixel circuit of the first light emitting unit is 2.0V, which causes the OLED of the first light emitting unit to emit light and the potential VRN of the fourth node N4 in the pixel circuit of the first light emitting unit to be −1.8V. The second black state voltage VB2 provided by the data signal line DATA to the pixel circuit of the third light emitting unit is 5.7V, which causes the potential VGN of the fourth node N4 in the pixel circuit of the third light emitting unit to be −2.1V. Although the potential VBN of the fourth node N4 in the pixel circuit of the third light emitting unit increases and a voltage difference between the anode and the cathode of the OLED of the third light emitting unit is 1.9V, it can still be ensured that the OLED of the third light emitting unit does not emit light. This is because the turn-on voltage of the OLED of the third light emitting unit is 2.65V to 2.75V and the voltage difference between the anode and the cathode of the OLED of the third light emitting unit is smaller than the turn-on voltage of the OLED. Because a difference value between the potential VRN of the fourth node N4 in the pixel circuit of the first light emitting unit and the potential VBN of the fourth node N4 in the pixel circuit of the third light emitting unit is relatively small (0.3V), a lateral leakage between the pixel circuit of the first light emitting unit and the pixel circuit of the third light emitting unit is reduced. A loss of the driving current in the OLED of the first light emitting unit is reduced, and the brightness of the OLED of the first light emitting unit is ensured. Thus, the grey crush phenomenon is avoided.

In a method for driving pixel circuits according to an exemplary embodiment of the present disclosure, in a case where the second light emitting unit emits light and the third light emitting unit is in the black state, the data voltage VG0 provided by the data signal line DATA to the pixel circuit of the second light emitting unit is 2.0V. The data signal line DATA provides the third black state voltage VB3 to the pixel circuit of the third light emitting unit. The third black state voltage VB3 is 5.7V, and is smaller than the reference black state voltage VB. The data voltage VG0 provided by the data signal line DATA to the pixel circuit of the second light emitting unit is 2.0V, which causes the OLED of the second light emitting unit to emit light and the potential VGN of the fourth node N4 in the pixel circuit of the second light emitting unit to be −1.8V. The third black state voltage VB3 provided by the data signal line DATA to the pixel circuit of the third light emitting unit is 5.7V, which causes the potential VGN of the fourth node N4 in the pixel circuit of the third light emitting unit to be −2.1V. Although the potential VBN of the fourth node N4 in the pixel circuit of the third light emitting unit increases and a voltage difference between the anode and the cathode of the OLED of the third light emitting unit is 2.0V, it can still be ensured that the OLED of the third light emitting unit does not emit light. This is because the turn-on voltage of the OLED of the third light emitting unit is 2.65V to 2.75V and the voltage difference between the anode and the cathode of the OLED of the third light emitting unit is smaller than the turn-on voltage of the OLED. Because a difference value between the potential VGN of the fourth node N4 in the pixel circuit of the second light emitting unit and the potential VBN of the fourth node N4 in the pixel circuit of the third light emitting unit is relatively small (0.3V), a lateral leakage between the pixel circuit of the second light emitting unit and the pixel circuit of the third light emitting unit is reduced. A loss of the driving current in the OLED of the second light emitting unit is reduced, and the brightness of the OLED of the second light emitting unit is ensured. Thus, the grey crush phenomenon is avoided.

In a method for driving pixel circuits according to an exemplary embodiment of the present disclosure, in a case where the first light emitting unit emits light and the second light emitting unit and the third light emitting unit are both in the black state, the data voltage VR0 provided by the data signal line DATA to the pixel circuit of the first light emitting unit is 2.0V. The data signal line DATA provides the first black state voltage VB1 and the second black state voltage VB2 to the pixel circuit of the second light emitting unit and the pixel circuit of the third light emitting unit, respectively. The first black state voltage VB1 and the second black state voltage VB2 are both smaller than the reference black state voltage VB. The data voltage VR0 provided by the data signal line DATA to the pixel circuit of the first light emitting unit is 2.0V, which causes the OLED of the first light emitting unit to emit light and the potential VRN of the fourth node N4 in the pixel circuit of the first light emitting unit to be −1.8V. The first black state voltage VB1 provided by the data signal line DATA to the pixel circuit of the second light emitting unit is 5.8V, and the second black state voltage VB2 provided by the data signal line DATA to the pixel circuit of the third light emitting unit is 5.8V, which causes the potential VGN of the fourth node N4 in the pixel circuit of the second light emitting unit to be −2.2V and the potential VBN of the fourth node N4 in the pixel circuit of the third light emitting unit to be −2.2V. The potentials of the fourth nodes N4 in the pixel circuits of the second light emitting unit and the third light emitting unit both increase, a voltage difference between the anode and the cathode of the OLED of the second light emitting unit is 1.8V, and a voltage difference between the anode and the cathode of the OLED of the third light emitting unit is 1.8V. However, because the turn-on voltage of the OLED of the second light emitting unit is 2.05 V to 2.10V, the turn-on voltage of the OLED of the third light emitting unit is 2.65 V to 2.75V and both of the voltage differences between the anodes and the cathodes of the OLEDs are smaller than the turn-on voltages of the OLEDs, it can still be ensured that the OLEDs of the second light emitting unit and the third light emitting unit do not emit light. Because a difference value between the potential VRN of the fourth node N4 in the pixel circuit of the first light emitting unit and the potential VGN of the fourth node N4 in the pixel circuit of the second light emitting unit is relatively small (0.4V) and a difference value between the potential VRN of the fourth node N4 in the pixel circuit of the first light emitting unit and the potential VBN of the fourth node N4 in the pixel circuit of the third light emitting unit is relatively small (0.4V), the lateral leakage between the pixel circuit of the first light emitting unit and the pixel circuit of the second light emitting unit is reduced, and the lateral leakage between the pixel circuit of the first light emitting unit and the pixel circuit of the third light emitting unit is reduced. A loss of the driving current in the OLED of the first light emitting unit is reduced, and the brightness of the OLED of the first light emitting unit is ensured. Thus, the grey crush phenomenon is avoided.

In an exemplary implementation, the reference black state voltage VB may be about 5.0V to 7.0V.

In an exemplary implementation, when the first light emitting unit emits light and the second light emitting unit is in the black state, the first black state voltage VB1 provided by the data signal line DATA to the pixel circuit of the second light emitting unit may be about 0.85*VB to 0.95*VB. In some possible implementations, the first black state voltage VB1 may be about 0.87*VB to 0.93*VB.

In an exemplary implementation, when the first light emitting unit emits light and the third light emitting unit is in the black state, the second black state voltage VB2 provided by the data signal line DATA to the pixel circuit of the third light emitting unit may be about 0.85*VB to 0.95*VB. In some possible implementations, the second black state voltage VB2 may be about 0.87*VB to 0.93*VB.

In an exemplary implementation, when the second light emitting unit emits light and the third light emitting unit is in the black state, the third black state voltage VB3 provided by the data signal line DATA to the pixel circuit of the third light emitting unit may be about 0.85*VB to 0.95*VB. In some possible implementations, the third black state voltage VB3 may be about 0.87*VB to 0.93*VB.

In an exemplary implementation, the second black state voltage VB2 may be equal to the third black state voltage VB3.

In an exemplary implementation, when the first light emitting unit emits light and the second light emitting unit and the third light emitting unit are both in the black state, the first black state voltage VB1 provided by the data signal line DATA to the pixel circuit of the second light emitting unit may be about 0.85*VB to 0.95*VB, and the second black state voltage VB2 provided by the data signal line DATA to the pixel circuit of the third light emitting unit may be about 0.85*VB to 0.95*VB. The first black state voltage VB1≥the second black state voltage VB2.

When the first light emitting unit emits light and the second light emitting unit and the third light emitting unit are both in the black state, a simulation result shows that: for the reference black state voltage being 6.1V, when the data voltages respectively provided by the data signal line DATA to the pixel circuits of the second light emitting unit and the third light emitting unit are both 6.1V, a ratio of an actual brightness to a theoretical brightness of the first light emitting unit is 0.41. When the data voltages respectively provided by the data signal line DATA to the pixel circuits of the second light emitting unit and the third light emitting unit are both 5.9V, the ratio of the actual brightness to the theoretical brightness of the first light emitting unit is 0.46. When the data voltages respectively provided by the data signal line DATA to the pixel circuits of the second light emitting unit and the third light emitting unit are both 5.8V, the ratio of the actual brightness to the theoretical brightness of the first light emitting unit is 0.47. When the data voltages respectively provided by the data signal line DATA to the pixel circuits of the second light emitting unit and the third light emitting unit are both 5.4V, the ratio of the actual brightness to the theoretical brightness of the first light emitting unit is 0.57.

Figure 8:
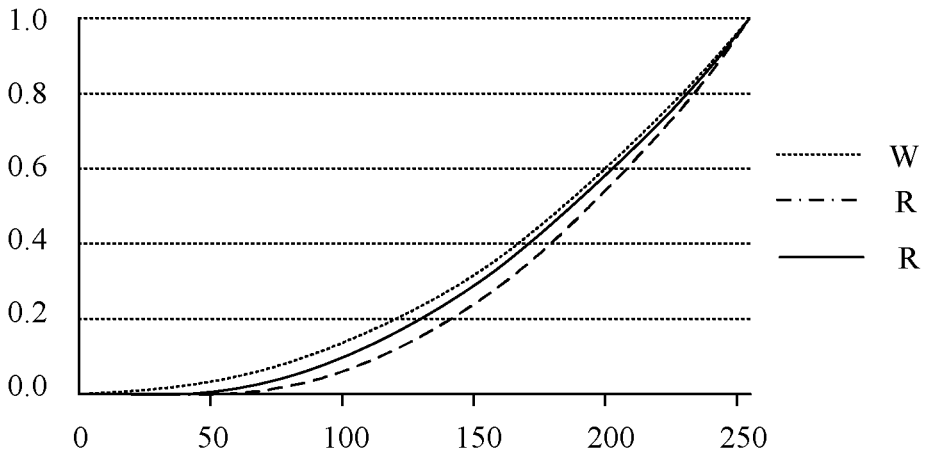
FIG. 8 is a schematic diagram illustrating a reduction of a grey crush according to an exemplary embodiment of the present disclosure.

FIG. 8 is a schematic diagram illustrating a reduction of a grey crush according to an exemplary embodiment of the present disclosure. An abscissa axis denotes a gray scale, an ordinate axis denotes brightness, a dashed line denotes a curve of white brightness, a dotted-dashed line denotes a curve of red brightness for a pixel-circuit driving method, and a solid line denotes a curve of red brightness of a method for driving pixel circuits according to an exemplary embodiment of the present disclosure. As shown in FIG. 8, in the curve of red brightness for the pixel-circuit driving method, the red brightness is basically 0 in a range from a "0" gray scale to a "75" gray scale. In the curve of red brightness of the method for driving pixel circuits according to an exemplary embodiment of the present disclosure, the red brightness is basically 0 in a range from a "0" gray scale to a "50" gray scale, but the brightness is gradually changed and increases as the gray scale increases in a range from a "50" gray scale to a "75" gray scale. According to an exemplary embodiment of the present disclosure, by setting the black state voltages of the different light emitting units, the lateral leakage between the light emitting units is reduced. The grey crush caused by the lateral leakage is reduced, and an image quality is improved.

In an exemplary implementation, when the first light emitting unit is in the black state, an initial voltage provided by the second initial signal line INIT2 to the pixel circuit of the first light emitting unit is referred to as a reference initial voltage VI.

In an exemplary implementation, when the first light emitting unit emits light and the second light emitting unit is in the black state, an initial voltage provided by the second initial signal line INIT2 to the pixel circuit of the second light emitting unit is referred to as a first initial voltage VC1. The first initial voltage VC1 is greater than the reference initial voltage VI.

In an exemplary implementation, when the first light emitting unit emits light and the third light emitting unit is in the black state, an initial voltage provided by the second initial signal line INIT2 to the pixel circuit of the third light emitting unit is referred to as a second initial voltage VC2. The second initial voltage VC2 is greater than the reference initial voltage VI.

In an exemplary implementation, when the second light emitting unit emits light and the third light emitting unit is in the black state, an initial voltage provided by the second initial signal line INIT2 to the pixel circuit of the third light emitting unit is referred to as a third initial voltage VC3. The third initial voltage VC3 is greater than the reference initial voltage VI.

In an exemplary implementation, when the first light emitting unit emits light and the second light emitting unit and the third light emitting unit are both in the black state, the first initial voltage VC1 provided by the second initial signal line INIT2 to the pixel circuit of the second light emitting unit is greater than the reference initial voltage VI, and the second initial voltage VC2 provided by the second initial signal line INIT2 to the pixel circuit of the third light emitting unit is greater than the reference initial voltage VI. The first initial voltage VC1≤the second initial voltage VC2.

In the following, illustrative description is provided by taking the power supply voltage Vss output by the first power supply line VSS being −4V, the data voltage output by the data signal line DATA being 2.0V to 6.1V and the initial voltage output by the second initial signal line INIT2 being −2.0V to −1.0V as an example.

When the first light emitting unit is in the black state, the reference initial voltage VI provided by the second initial signal line INIT2 to the pixel circuit of the first light emitting unit is −2.0V, which causes the potential of the fourth node N4 in the pixel circuit of the first light emitting unit to be −2.0V. The low potential of the fourth node N4 can not only cause a voltage difference between the anode and the cathode of the OLED to be smaller than a turn-on voltage of the OLED, but also can absorb a leakage current of the third transistor T3 to ensure that the OLED does not emit light.

In a method for driving pixel circuits, in a case where the first light emitting unit emits light and the second light emitting unit is in the black state, in the second stage A2 (the data writing stage or the threshold compensation stage), the initial voltages provided by the second initial signal line INIT2 to the pixel circuits of the first light emitting unit and the second light emitting unit are both −2.0V (the reference initial voltage), which causes both of the potentials of the fourth nodes N4 in the pixel circuits of the first light emitting unit and the second light emitting unit to be −2.0V. In the third stage A3 (the light emitting stage), the data voltage provided by the data signal line DATA to the pixel circuit of the first light emitting unit is 2.0V, and the data voltage provided by the data signal line DATA to the pixel circuit of the second light emitting unit is 6.1V, which causes the potential VRN of the fourth node N4 in the pixel circuit of the first light emitting unit to be −1.8V and the potential of the fourth node N4 in the pixel circuit of the second light emitting unit to be −4.0V. Because a difference value between the potential VRN of the fourth node N4 in the pixel circuit of the first light emitting unit and the potential VGN of the fourth node N4 in the pixel circuit of the second light emitting unit is relatively large (2.2V), a driving current of the pixel circuit of the first light emitting unit may flow to the pixel circuit of the second light emitting unit, resulting in a lateral leakage. The driving current that flows through the OLED of the first light emitting unit is reduced. Then, the brightness of the OLED of the first light emitting unit is reduced, resulting in a grey crush.

In a method for driving pixel circuits according to another exemplary embodiment of the present disclosure, in a case where the first light emitting unit emits light and the second light emitting unit is in the black state, in the second stage A2, the second initial signal line INIT2 provides the reference initial voltage VI to the pixel circuit of the first light emitting unit, and the second initial signal line INIT2 provides the first initial voltage VC1 to the pixel circuit of the second light emitting unit. The first initial voltage VC1 is −1.8V, and is greater than the reference initial voltage VI. In the third stage A3, the data voltage provided by the data signal line DATA to the pixel circuit of the first light emitting unit is 2.0V. When the OLED of the first light emitting unit emits light, the potential of the fourth node N4 in the pixel circuit of the first light emitting unit is −1.8V. The data signal line DATA provides the first black state voltage VB1 to the pixel circuit of the second light emitting unit, and the first black state voltage VB1 is 5.8V, which causes the potential of the fourth node N4 in the pixel circuit of the second light emitting unit to be −2.0V. Because the first initial voltage VC1 provided by the second initial signal line INIT2 to the pixel circuit of the second light emitting unit in the second stage A2 is greater than the reference initial voltage VI, the potential of the fourth node N4 in the pixel circuit of the second light emitting unit in the third stage A3 is raised. A difference value between the potential of the fourth node N4 in the pixel circuit of the first light emitting unit and the potential of the fourth node N4 in the pixel circuit of the second light emitting unit is further reduced. The lateral leakage between the first light emitting unit and the second light emitting unit is reduced, and the brightness of the OLED of the first light emitting unit is ensured. The grey crush phenomenon is avoided.

In a method for driving pixel circuits according to another exemplary embodiment of the present disclosure, in a case where the first light emitting unit emits light and the third light emitting unit is in the black state, in the second stage A2, the second initial signal line INIT2 provides the reference initial voltage VI to the pixel circuit of the first light emitting unit, and the second initial signal line INIT2 provides the second initial voltage VC2 to the pixel circuit of the third light emitting unit. The second initial voltage VC2 is −1.8V, and is greater than the reference initial voltage VI. In the third stage A3, the data voltage provided by the data signal line DATA to the pixel circuit of the first light emitting unit is 2.0V. When the OLED of the first light emitting unit emits light, the potential of the fourth node N4 in the pixel circuit of the first light emitting unit is −1.8V. The data signal line DATA provides the second black state voltage VB2 to the pixel circuit of the third light emitting unit, and the second black state voltage VB2 is 5.7V, which causes the potential of the fourth node N4 in the pixel circuit of the third light emitting unit to be −1.9V. Because the second initial voltage VC2 provided by the second initial signal line INIT2 to the pixel circuit of the third light emitting unit in the second stage A2 is greater than the reference initial voltage VI, the potential of the fourth node N4 in the pixel circuit of the third light emitting unit in the third stage A3 is raised. A difference value between the potential of the fourth node N4 in the pixel circuit of the first light emitting unit and the potential of the fourth node N4 in the pixel circuit of the third light emitting unit is further reduced. The lateral leakage between the first light emitting unit and the third light emitting unit is reduced, and the brightness of the OLED of the first light emitting unit is ensured. The grey crush phenomenon is avoided.

In a method for driving pixel circuits according to an exemplary embodiment of the present disclosure, in a case where the second light emitting unit emits light and the third light emitting unit is in the black state, in the second stage A2, the second initial signal line INIT2 provides the reference initial voltage VI to the pixel circuit of the second light emitting unit, and the second initial signal line INIT2 provides the third initial voltage VC3 to the pixel circuit of the third light emitting unit. The third initial voltage VC3 is −1.8V, and is greater than the reference initial voltage VI. In the third stage A3, the data voltage provided by the data signal line DATA to the pixel circuit of the second light emitting unit is 2.0V. When the OLED of the second light emitting unit emits light, the potential of the fourth node N4 in the pixel circuit of the second light emitting unit is −1.8V. The data signal line DATA provides the third black state voltage VB3 to the pixel circuit of the third light emitting unit, and the third black state voltage VB3 is 5.7V, which causes the potential of the fourth node N4 in the pixel circuit of the third light emitting unit to be −1.9V. Because the third initial voltage VC3 provided by the second initial signal line INIT2 to the pixel circuit of the third light emitting unit in the second stage A2 is greater than the reference initial voltage VI, the potential of the fourth node N4 in the pixel circuit of the third light emitting unit in the third stage A3 is raised. A difference value between the potential of the fourth node N4 in the pixel circuit of the second light emitting unit and the potential of the fourth node N4 in the pixel circuit of the third light emitting unit is further reduced. The lateral leakage between the second light emitting unit and the third light emitting unit is reduced, and the brightness of the OLED of the second light emitting unit is ensured. The grey crush phenomenon is avoided.

In a method for driving pixel circuits according to an exemplary embodiment of the present disclosure, in a case where the first light emitting unit emits light and the second light emitting unit and the third light emitting unit are both in the black state, in the second stage A2, the second initial signal line INIT2 provides the reference initial voltage VI to the pixel circuit of the first light emitting unit. The second initial signal line INIT2 provides the first initial voltage VC1 to the pixel circuit of the second light emitting unit. The second initial signal line INIT2 provides the second initial voltage VC2 to the pixel circuit of the third light emitting unit. Both the first initial voltage VC1 and the second initial voltage VC2 are −1.8V, and are greater than the reference initial voltage VI. In the third stage A3, the data voltage provided by the data signal line DATA to the pixel circuit of the first light emitting unit is 2.0V. When the OLED of the first light emitting unit emits light, the potential of the fourth node N4 in the pixel circuit of the first light emitting unit is −1.8V. The data signal line DATA provides the first black state voltage VB1 to the pixel circuit of the second light emitting unit, and the first black state voltage VB1 is 5.8V, which causes the potential of the fourth node N4 in the pixel circuit of the second light emitting unit to be −2.0V. The data signal line DATA provides the second black state voltage VB2 to the pixel circuit of the third light emitting unit, and the second black state voltage VB2 is 5.7V, which causes the potential of the fourth node N4 in the pixel circuit of the third light emitting unit to be −1.9V. Because the first initial voltage VC1 provided by the second initial signal line INIT2 to the pixel circuit of the second light emitting unit in the second stage A2 is greater than the reference initial voltage VI, and the second initial voltage VC2 provided by the second initial signal line INIT2 to the pixel circuit of the third light emitting unit is greater than the reference initial voltage VI, the potentials of the fourth nodes N4 in the pixel circuits of the second light emitting unit and the third light emitting unit in the third stage A3 are raised. The lateral leakage between the first light emitting unit and the second light emitting unit as well as the lateral leakage between the first light emitting unit and the third light emitting unit is reduced, and the brightness of the OLED of the first light emitting unit is ensured. The grey crush phenomenon is avoided.

In an exemplary implementation, the reference initial voltage VI may be about −2.2V to −2.0V.

In an exemplary implementation, when the first light emitting unit emits light and the second light emitting unit is in the black state, the first initial voltage VC1 provided by the second initial signal line INIT2 to the pixel circuit of the second light emitting unit may be about 0.9*VI to 0.7*VI. In some possible implementations, the first initial voltage VC1 may be about 0.85*VI to 0.75*VI.

In an exemplary implementation, when the first light emitting unit emits light and the third light emitting unit is in the black state, the second initial voltage VC2 provided by the second initial signal line INIT2 to the pixel circuit of the third light emitting unit may be about 0.9*VI to 0.7*VI. In some possible implementations, the second initial voltage VC2 may be about 0.85*VI to 0.75*VI.

In an exemplary implementation, when the second light emitting unit emits light and the third light emitting unit is in the black state, the third initial voltage VC3 provided by the second initial signal line INIT2 to the pixel circuit of the third light emitting unit may be about 0.9*VI to 0.7*VI. In some possible implementations, the third initial voltage VC3 may be about 0.85*VI to 0.75*VI.

In an exemplary implementation, when the first light emitting unit emits light and the second light emitting unit and the third light emitting unit are both in the black state, the first initial voltage VC1 provided by the second initial signal line INIT2 to the pixel circuit of the second light emitting unit may be about 0.9*VI to 0.7*VI. The second initial voltage VC2 provided by the second initial signal line INIT2 to the pixel circuit of the third light emitting unit may be about 0.9*VI to 0.7*VI. The first initial voltage VC1≤the second initial voltage VC2.

In an exemplary implementation, the second initial voltage VC2 may be equal to the third initial voltage VC3.

When the first light emitting unit emits light and the second light emitting unit and the third light emitting unit are both in the black state, a simulation result shows that: for the reference initial voltage being −2.0V, when the initial voltages provided by the second initial signal line INIT2 to the pixel circuits of the first light emitting unit, the second light emitting unit and the third light emitting unit are all −2.0V, the ratio of the actual brightness to the theoretical brightness of the first light emitting unit is 0.41. When the initial voltage provided by the second initial signal line INIT2 to the pixel circuit of the first light emitting unit is −2.0 V and the initial voltages provided by the second initial signal line INIT2 to the pixel circuits of the second light emitting unit and the third light emitting unit are both −1.8V, the ratio of the actual brightness to the theoretical brightness of the first light emitting unit is 0.46. When the initial voltage provided by the second initial signal line INIT2 to the pixel circuit of the first light emitting unit is −2.0 V and the initial voltages provided by the second initial signal line INIT2 to the pixel circuits of the second light emitting unit and the third light emitting unit are both −1.7V, the ratio of the actual brightness to the theoretical brightness of the first light emitting unit is 0.47. When the initial voltage provided by the second initial signal line INIT2 to the pixel circuit of the first light emitting unit is −2.0V and the initial voltages provided by the second initial signal line INIT2 to the pixel circuits of the second light emitting unit and the third light emitting unit are both −1.5V, the ratio of the actual brightness value to the theoretical brightness value of the first light emitting unit is 0.57. According to an exemplary embodiment of the present disclosure, by setting the initial voltages of the different light emitting units, the lateral leakage between the light emitting units is reduced. The grey crush caused by the lateral leakage is reduced, and the image quality is improved.

An exemplary embodiment of the present disclosure further provides a display panel. The display panel is driven by a driving method of a display panel in any of the foregoing embodiments.

An exemplary embodiment of the present disclosure further provides a display apparatus, including the aforementioned display panel. The display apparatus may be a mobile phone, a tablet computer, a television, a display device, a laptop computer, a digital photo frame, a navigator, or another product or component with a display function.

Although implementations disclosed in the present disclosure are as the above, the described contents are only implementations used for facilitating understanding the present disclosure, and are not used to limit the present disclosure. Any person skilled in the field to which the present disclosure pertains may make any modifications and variations in the forms and details of implementation without departing from the spirit and the scope disclosed by the present disclosure. However, the patent protection scope of the present disclosure shall still be subject to the scope defined in the appended claims.

What is claimed is:

1. A driving method of a display panel, wherein the display panel includes a plurality of pixel units that are arranged regularly, at least one of the plurality of pixel units comprises a first light emitting unit which emits light of a first color, a second light emitting unit which emits light of a second color and a third light emitting unit which emits light of a third color, each light emitting unit comprises a pixel circuit and a light emitting device electrically connected with the pixel circuit, the pixel circuit is connected with a scanning signal line and a data signal line, the pixel circuit receives a data voltage transmitted by the data signal line and outputs a corresponding current to the light emitting device under a control of the scanning signal line, and when the first light emitting unit is in a black state, the data signal line provides a reference black state voltage to a pixel circuit of the first light emitting unit, the driving method comprising:

providing, by the data signal line, a first black state voltage to a pixel circuit of the second light emitting unit when the first light emitting unit emits light and the second light emitting unit is in the black state, wherein the first black state voltage is less than the reference black state voltage;

wherein a turn-on voltage of a light emitting device of the first light emitting unit is less than or equal to a turn-on voltage of a light emitting device of the second light emitting unit, and the turn-on voltage of the light emitting device of the second light emitting unit is less than or equal to a turn-on voltage of a light emitting device of the third light emitting unit;

wherein the pixel circuit is further connected with an initial signal line, the initial signal line provides a reference initial voltage to the pixel circuit of the first light emitting unit, and the driving method further comprises:

providing, by the initial signal line, a first initial voltage to the pixel circuit of the second light emitting unit when the first light emitting unit emits light and the second light emitting unit is in the black state, wherein the first initial voltage is greater than the reference initial voltage.

2. The driving method according to claim 1, further comprising:

providing, by the data signal line, a second black state voltage to a pixel circuit of the third light emitting unit when the first light emitting unit emits light and the third light emitting unit is in the black state, wherein the second black state voltage is less than the reference black state voltage.

3. The driving method according to claim 2, wherein the first black state voltage is greater than or equal to the second black state voltage.

4. The driving method according to claim 2, wherein a turn-on voltage of a light emitting device of the first light emitting unit is less than or equal to a turn-on voltage of a light emitting device of the second light emitting unit, and the turn-on voltage of the light emitting device of the second light emitting unit is less than or equal to a turn-on voltage of a light emitting device of the third light emitting unit.

5. The driving method according to claim 4, wherein the turn-on voltage of the light emitting device of the first light emitting unit is 2.0V to 2.05V, the turn-on voltage of the light emitting device of the second light emitting unit is 2.05V to 2.10V, the turn-on voltage of the light emitting device of the third light emitting unit is 2.65V to 2.75V, and the reference black state voltage is 5.0V to 7.0V.

6. The driving method according to claim 4, wherein the pixel circuit is further connected with an initial signal line, the initial signal line provides a reference initial voltage to the pixel circuit of the first light emitting unit, and the driving method further comprises:

providing, by the initial signal line, a first initial voltage to the pixel circuit of the second light emitting unit when the first light emitting unit emits light and the second light emitting unit is in the black state, wherein the first initial voltage is greater than the reference initial voltage.

7. The driving method according to claim 1, wherein the turn-on voltage of the light emitting device of the first light emitting unit is 2.0V to 2.05V, the turn-on voltage of the light emitting device of the second light emitting unit is 2.05V to 2.10V, the turn-on voltage of the light emitting device of the third light emitting unit is 2.65V to 2.75V, and the reference black state voltage is 5.0V to 7.0V.

8. The driving method according to claim 1, wherein the first black state voltage is 0.85*the reference black state voltage to 0.95 *the reference black state voltage.

9. The driving method according to claim 1, wherein a second black state voltage is 0.85*the reference black state voltage to 0.95 *the reference black state voltage.

10. The driving method according to claim 1, further comprising:

providing, by the initial signal line, a second initial voltage to a pixel circuit of the third light emitting unit when the first light emitting unit emits light and the third light emitting unit is in the black state, wherein the second initial voltage is greater than the reference initial voltage.

11. The driving method according to claim 10, wherein the first initial voltage is less than or equal to the second initial voltage.

12. The driving method according to claim 1, wherein the reference initial voltage is −2.2V to −2.0V.

13. The driving method according to claim 1, wherein the first initial voltage is 0.9*the reference initial voltage to 0.7*the reference initial voltage.

14. The driving method according to claim 1, wherein a second initial voltage is 0.9*the reference initial voltage to 0.7*the reference initial voltage.

15. The driving method according to claim 1, wherein the pixel circuit comprises: a first transistor with a control electrode connected with a second scanning signal line, a first electrode connected with a first initial signal line and a second electrode connected with a second node; a second transistor with a control electrode connected with a first scanning signal line, a first electrode connected with the second node and a second electrode connected with a third node; a third transistor with a control electrode connected with the second node, a first electrode connected with a first node and a second electrode connected with the third node; a fourth transistor with a control electrode connected with the first scanning signal line, a first electrode connected with the data signal line and a second electrode connected with the first node; a fifth transistor with a control electrode connected with a light emitting signal line, a first electrode connected with a second power supply line and a second electrode connected with the first node; a sixth transistor with a control electrode connected with the light emitting signal line, a first electrode connected with the third node and a second electrode connected with a first electrode of the light emitting device; a seventh transistor with a control electrode connected with the first scanning signal line, a first electrode connected with a second initial signal line and a second electrode connected with the first electrode of the light emitting device, wherein a second electrode of the light emitting device is connected with a first power supply line; and a storage capacitor with a first end connected with the second power supply line and a second end connected with the second node.

16. The driving method according to claim 15, wherein the initial signal line is the second initial signal line.

17. A display panel driven by the driving method of the display panel according to claim 1.

18. A display apparatus comprising the display panel according to claim 17.

* * * * *